US006770171B2

(12) United States Patent
Hämäläinen et al.

(10) Patent No.: US 6,770,171 B2
(45) Date of Patent: Aug. 3, 2004

(54) METHOD AND SYSTEM FOR CONTROLLING HEADBOX IN A PAPER/BOARD MACHINE

(75) Inventors: Jari P. Hämäläinen, Palokka (FI); Hannu Lepomäki, Laukka (FI); Juhana Lumiala, Jyväskylä (FI); Pasi Sirviö, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/168,490

(22) PCT Filed: Dec. 29, 2000

(86) PCT No.: PCT/FI00/01164

§ 371 (c)(1),
(2), (4) Date: Oct. 9, 2002

(87) PCT Pub. No.: WO01/49929

PCT Pub. Date: Jul. 12, 2001

(65) Prior Publication Data

US 2003/0056918 A1 Mar. 27, 2003

(30) Foreign Application Priority Data

Dec. 30, 1999 (FI) ..... 19992823

(51) Int. Cl.[7] ..... D21F 1/02; D21F 7/06

(52) U.S. Cl. ..... 162/198; 162/212; 162/259; 162/262; 162/263; 162/343; 162/346; 162/DIG. 6; 700/128

(58) Field of Search ..... 162/198, 252, 162/253, 254, 259, 262, 263, 336, 343–347, 212–216, DIG. 6, DIG. 10, DIG. 11; 700/127–129

(56) References Cited

U.S. PATENT DOCUMENTS 3,464,887 A * 9/1969 Salomon ..... 162/263
3,573,160 A * 3/1971 Lopas ..... 162/259
3,878,039 A * 4/1975 Descary et al. ..... 162/336
4,832,794 A * 5/1989 Lyytinen ..... 162/198
4,898,643 A * 2/1990 Weisshuhn et al. ..... 162/259
5,145,560 A * 9/1992 Grenlulnd ..... 162/198
6,106,671 A * 8/2000 Heaven et al. ..... 162/198

FOREIGN PATENT DOCUMENTS

| | | |
|---|---|---|
| DE | 3715329 A1 | 9/1988 |
| EP | 0075782 A2 | 4/1983 |
| FI | 86445 | 5/1992 |
| GB | 2201173 A | 8/1988 |
| WO | WO 97/39182 A1 | 10/1997 |
| WO | WO 01/21885 A1 | 3/2001 |
| WO | WO 01/49929 A1 | 7/2001 |

OTHER PUBLICATIONS

International Search Report issued in PCT/FI00/01164, Apr. 30, 2001.

International Preliminary Examination Report issued in PCT/FI00/01164 Apr. 2, 2002.

* cited by examiner

*Primary Examiner*—Steven P. Griffin
*Assistant Examiner*—Eric Hug
(74) *Attorney, Agent, or Firm*—Stiennon & Stiennon

(57) ABSTRACT

A paper/board machine headbox (10) has a stock inlet header (J), a tube bank (11), a turbulence generator (13) and a slice opening (14) which is provided with a profile bar. The headbox (10) is provided with cross direction measuring sensors ($D_1$, $D_2$; $D_{mn}$), by means of which the flow rate profile of the headbox (10) is determined, and the profile bar of the slice opening (14) of the headbox (10) is adjusted in the cross direction on the basis of the thus determined flow rate profile. The headbox (10) is provided with measuring sensors ($D_1$, $D_2$; $D_{mn}$) for determining the cross direction flow rate profile of the headbox (10) and with means for adjusting the profile bar on the basis of the flow rate profile.

10 Claims, 4 Drawing Sheets

METHOD AND SYSTEM FOR CONTROLLING HEADBOX IN A PAPER/BOARD MACHINE

CROSS REFERENCES TO RELATED APPLICATIONS

This application is a U.S. national stage application of International Application No. PCT/FI00/01164, filed Dec. 29, 2000, and claims priority on Finnish Application No. 19992823 filed Dec. 30, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method and a system for controlling a headbox in a paper machine or in a board machine.

The profile faults which occur in fibre orientation on paper/board machines have been substantially reduced by means of dilution technology, but unevenness of fibre orientation can still be observed in paper, which unevenness appears as a so-called S-profile (the curve plotted with an unbroken line in FIG. 4). The S-profile in fibre orientation may be caused, for example, by an uneven pressure profile of a stock inlet header or a dilution inlet header, which gives rise to unevenness in flow rate profiles. The regulated consistency profile may also produce an undesirable pressure loss coefficient profile across a turbulence generator. The effect of this on the flow rate profile is seen such that at those points where the pressure loss coefficient is small, the flow rate increases and, in a corresponding manner, at points of high pressure loss coefficients, the flow rate decreases.

Another quantity difficult to control is the control of the jet speed in particular in headboxes with trailing elements. The problem is encountered both when using turbulence trailing elements and in multi-layer headboxes. In accordance with the state of the art, the jet velocity is predicted by means of a pressure measured from a side wall of a slice channel. However, this measurement method is inaccurate, for example, because of the flow disturbances arising from additional feeds and from trailing elements. Moreover, if there is an uneven pressure profile in the width direction of the slice channel, a value that has been measured from the side wall does not provide any information about pressure values elsewhere in the slice channel or in the cross direction of the machine.

SUMMARY OF THE INVENTION

An object of the invention is to develop a method and a device for measuring the flow rate profile in a slice channel of a headbox. Additionally, an object of the invention is to develop a control method for controlling the fibre orientation profile based on the flow rate profile. The flow rate profile can be measured either directly or indirectly.

The method for controlling a headbox of a paper/board machine according to the invention is mainly characterized in that the headbox is provided with cross direction measuring sensors, by means of which the flow rate profile in the slice channel of the headbox is determined, and the profile bar of the slice opening of the headbox is adjusted in the cross direction on the basis of the thus determined flow rate profile.

The measurement and control system according to the invention is in turn characterized in that the headbox is provided with measuring sensors for determining the cross direction flow rate profile in the slice channel of the headbox and with means for adjusting the profile bar on the basis of the flow rate profile.

The method and the system according to the invention allow the flow rate profile to be measured from the slice channel in the cross direction and/or in the machine direction. Based on accurate determination of the flow rate profile, the profile bar is adjusted such that cross velocities and orientation angles are minimised. In the measurement of the flow rate profile it is possible to use several methods, which are described further on. The invention provides correction of fibre orientation profiles which is more accurate than before.

In the following, the invention will be described with reference to the graphic representations shown in the accompanying figures and illustrating the invention and to a drawing of principle showing a measurement system of a headbox according to the invention, to which the invention is not intended to be exclusively confined.

DESCRIPTION OF THE PREFERRED EMBODIMENTS

Figure 1:
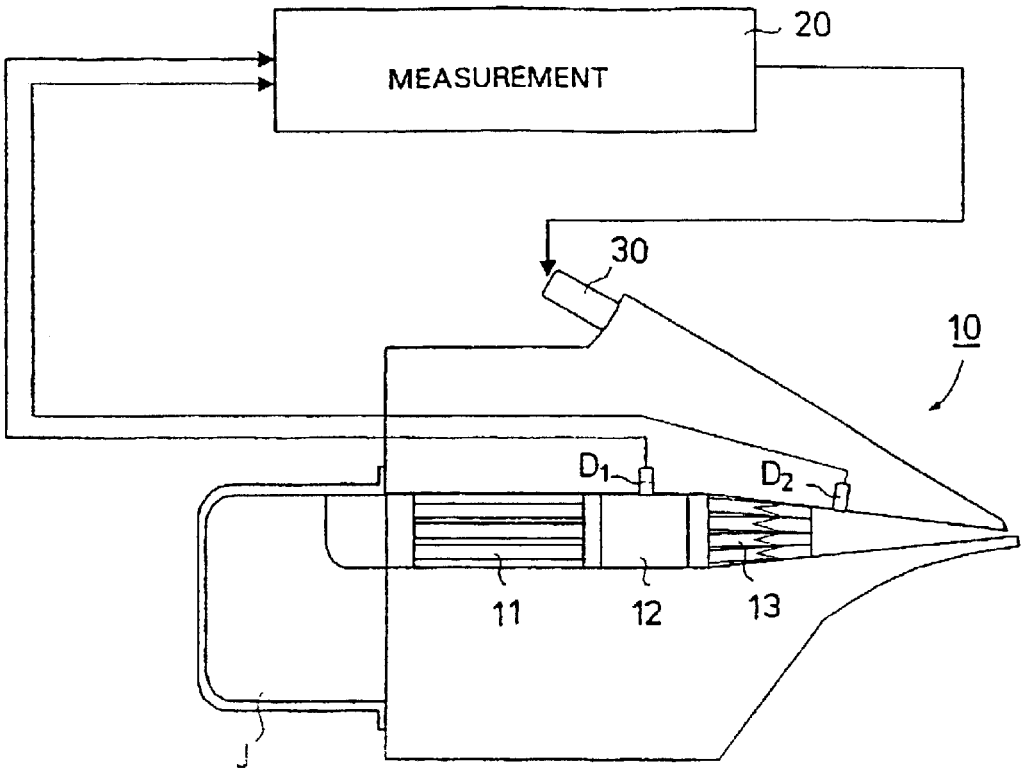
FIG. 1 shows a measurement and control system according to the invention.

FIG. 1 shows the measurement and control principle according to the invention. FIG. 1 is a sectional view of principle of a headbox 10 of a paper/board machine. The headbox 10 comprises an inlet header J, from which a flow is passed through a tube bank 11 into an intermediate chamber 12 and from it further into turbulence tubes of a turbulence generator 13. Measuring sensors $D_1$ are placed in the intermediate chamber 12 in the cross direction of the headbox 10 and cross direction measuring sensors $D_2$ are placed in a slice part after the turbulence generator 13. The measuring sensors $D_1$, $D_2$ comprise one or more sensor members which form a cross direction sensor assembly. The measuring sensors $D_1$, $D_2$ are, for example, pressure sensors and they can also be placed in a manner other than that shown in FIG. 1.

Measuring signals indicating, for example, static pressure are passed from the measuring sensors $D_1$, $D_2$ to a unit 20 for calculating the flow rate profile, in which unit the flow rate level and the flow rate profile used for the adjustment of a profile bar are determined from the pressure difference profile calculated from pressure profiles. The flow rate profile calculating unit 20 gives as a result a control signal to a profile bar adjustment unit 30. The profile bar is adjusted based on the measured quantities such that the cross velocities and orientation angles of the stock flow are minimised.

Figure 2:
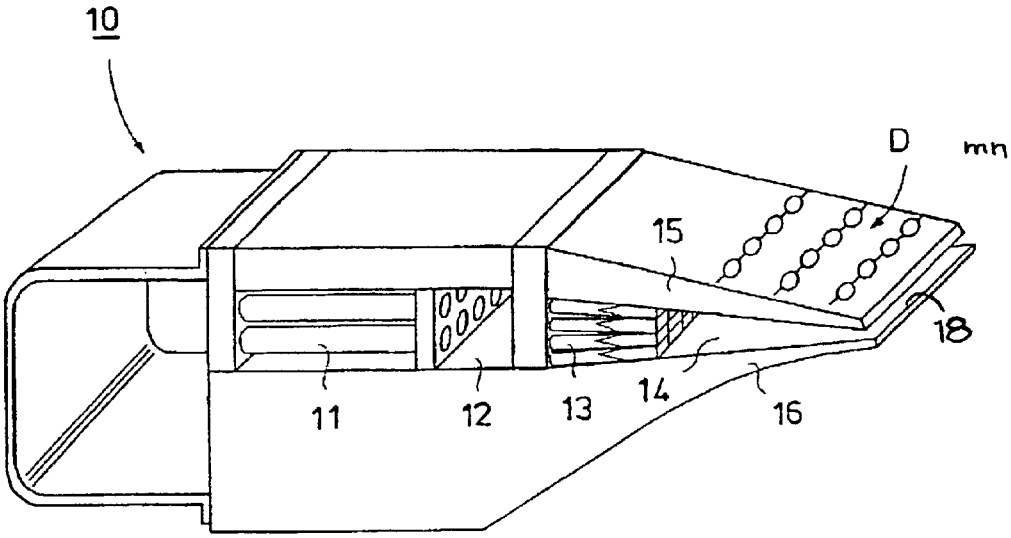
FIG. 2 shows an example of the positioning of a pressure sensor matrix in a headbox.

FIG. 2 shows an example of the positioning of measuring sensors for determining the pressure profile. In the arrangement of this example, the headbox 10 is provided with a pressure sensor matrix $D_{mn}$, by means of which the pressure profile in the slice channel 14 is determined. The pressure sensors $D_{mn}$ may also comprise one cross direction row of pressure sensors. FIG. 2 shows an upper lip 15, a lower lip 16 and a slice channel 14 between them ending in a slice opening 18, as an axonometric illustration. The sensors $D_{mn}$ are placed in the upper lip 15 and/or the lower lip 16 advantageously in a row with a uniform spacing or in a matrix at sufficiently short intervals, for example, at 10 cm intervals, thereby achieving a sufficiently accurate measurement of the variations in pressure in the cross direction and/or in the machine direction. The pressure sensors can also be placed in trailing elements by means of a similar arrangement.

As the measuring sensors it is also possible to use acceleration transducers or surface friction detectors or sensors based on ultrasonic measurement, optical measurement, microwave measurement or radioactive radiation. Instead of a cross direction measuring sensor row or matrix it is also possible to use one or more traversing measuring sensors.

Figure 3A:
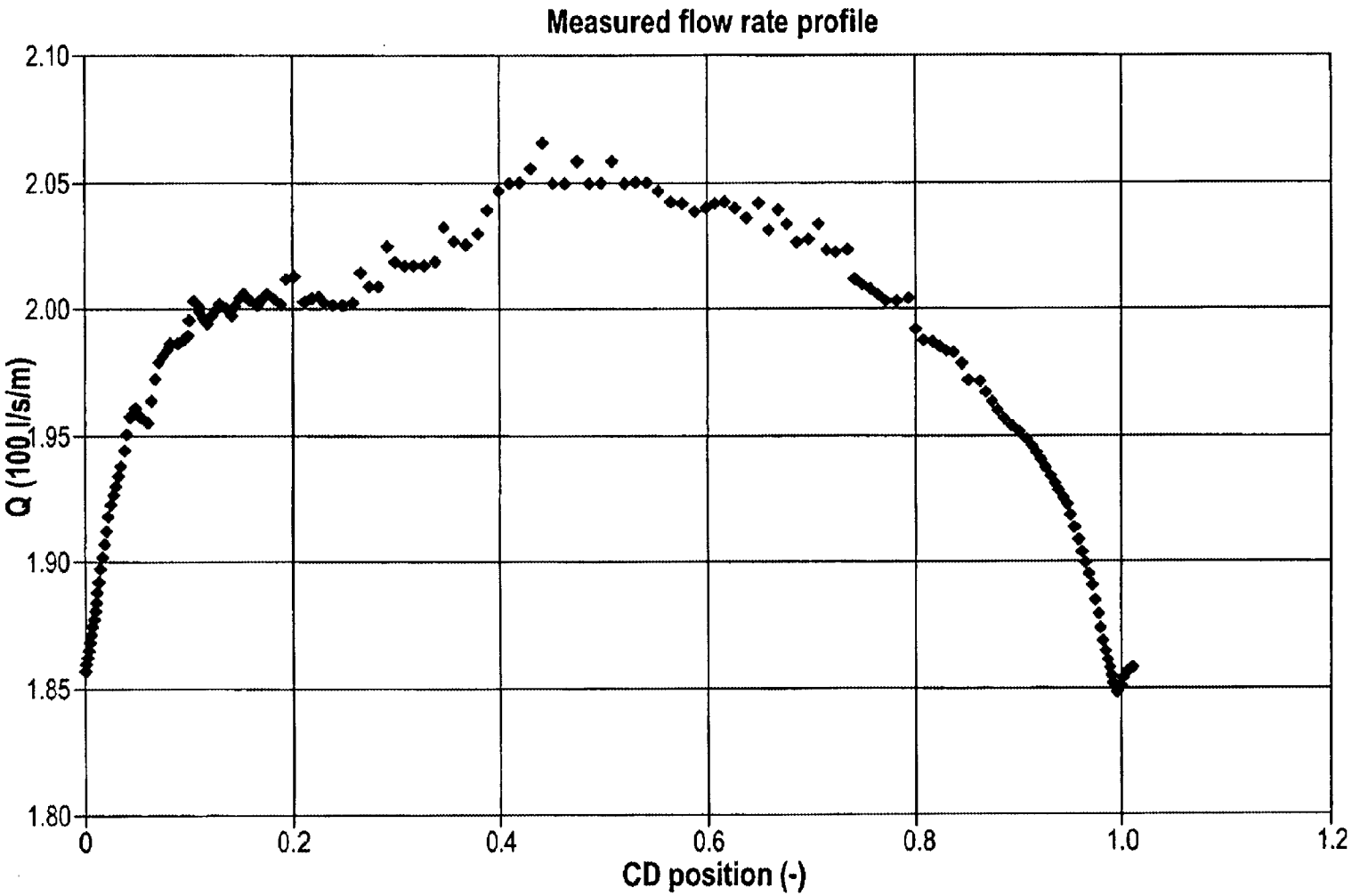
FIG. 3A shows a flow rate profile measured from a headbox.
Figure 3B:
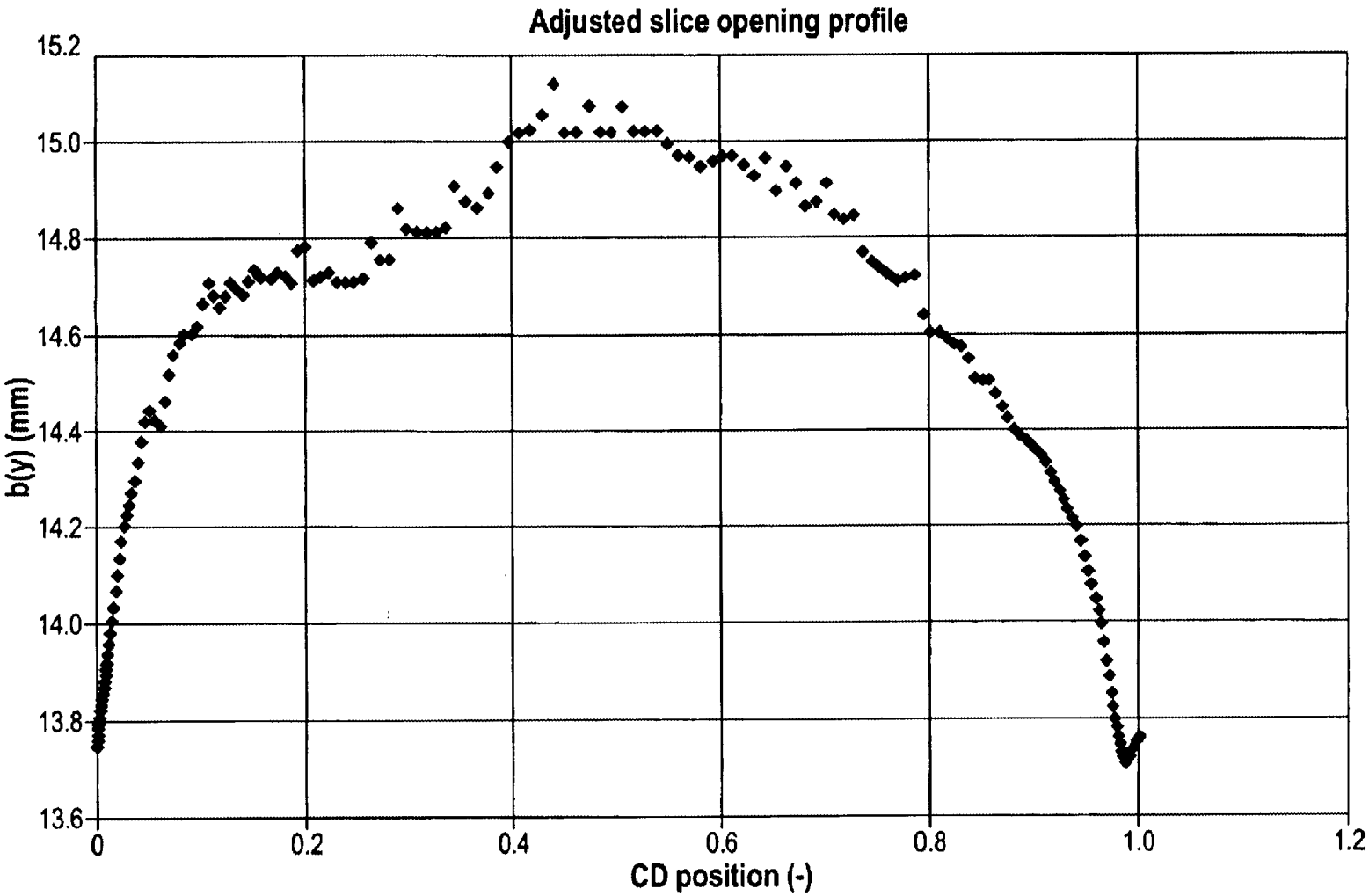
FIG. 3B shows a slice opening profile controlled based on the flow rate profile.

FIG. 3A shows a flow rate profile measured from a headbox by means of the method and system according to the invention. In the figure, the horizontal axis represents the cross direction location, the vertical axis represents the flow rate Q, the unit of which is 100 l/s/m and in the figure each measurement point is represented by a diamond. FIG. 3B shows a slice opening profile curve controlled based on the flow rate profile measured in FIG. 3A. The horizontal axis represents the cross direction location and the vertical axis represents the dimension b(y) of the slice opening, the unit of which is a millimetre.

Figure 4:
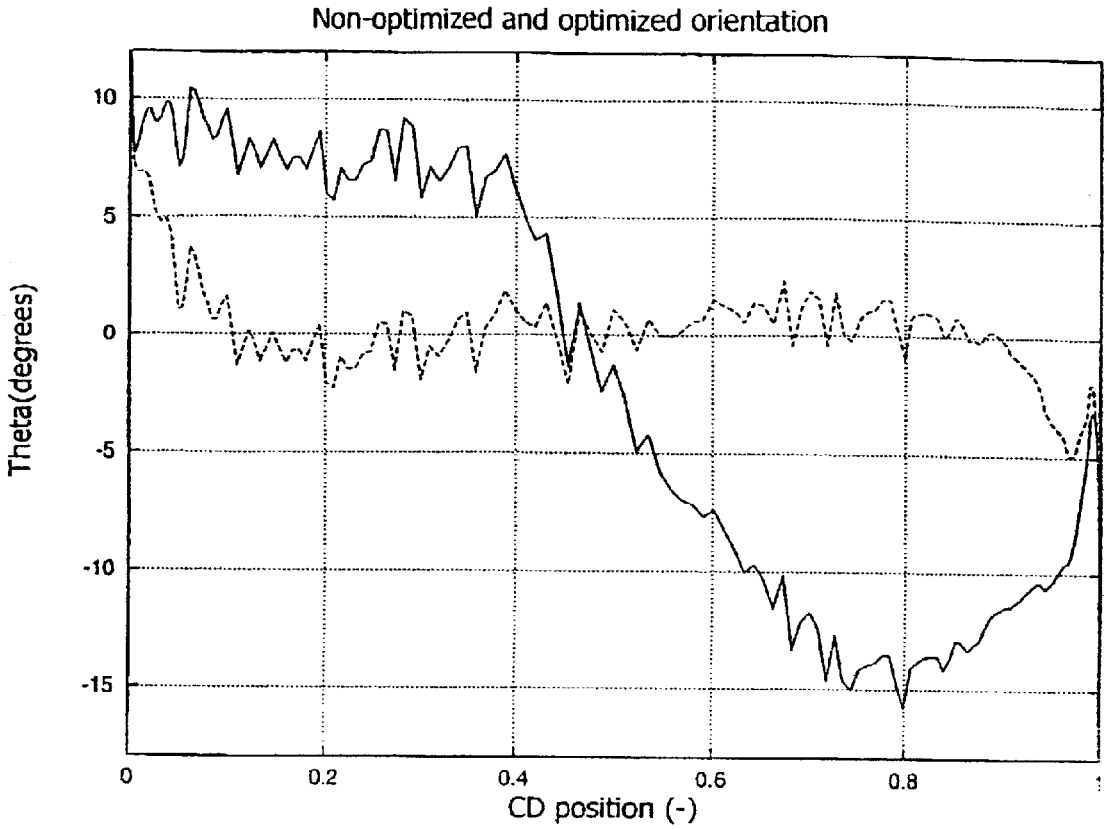
FIG. 4 shows a fibre orientation profile according to prior art and a fibre orientation profile provided by the method according to the invention.

FIG. 4 shows two fibre orientation curves. The curve plotted with an unbroken line represents the fibre orientation of paper produced by a headbox according to the state of the art. Here, a clear S-profile is observed. The graph plotted with a broken line represents fibre orientation that has been made uniform by control according to the invention. In FIG. 4, the horizontal axis represents the cross direction location and the vertical axis represents the deviation of fibre orientation in degrees.

Thus, the method and the measurement and control system according to the invention make it possible to correct the S-profile occurring in the fibre orientation profile, with the result that the fibre orientation profile can be made considerably more uniform than that achieved by the systems according to the state of the art.

In the following, the claims arc presented to which the invention is not intended to be exclusively confined.

What is claimed is:

1. A method for controlling a headbox in a paper/board machine, wherein the headbox comprises a stock inlet header, a tube bank, a turbulence generator and a slice channel the slice opening of which is provided with a profile bar, and wherein the headbox is provided with a cross direction measuring assembly selected from the group consisting of a plurality of cross direction sensors and at least one traversing sensor, the method comprising the steps of:

determining a flow rate profile in the slice channel of the headbox by means of the cross machine direction measuring assembly;

adjusting the profile bar of the slice opening in the cross direction on basis of the flow rate profile; and wherein the flow rate profile is determined by measuring the pressure profile before and after the turbulence generator and the flow rate profile is determined based on the difference in the pressure profiles.

2. The method of claim 1 wherein the cross machine direction sensors are selected from the group consisting of ultrasonic sensors, surface friction detectors, acceleration transducers, microwave sensors, sensors based on optical measurement, and sensors based on the use of radioactive radiation.

3. The method of claim 1 wherein the shape of the slice opening is adjusted so as to be in the shape of the determined flow rate profile.

4. A method for controlling a headbox in a paper/board machine, wherein the headbox comprises a stock inlet header, a tube bank, a turbulence generator and a slice channel the slice opening of which is provided with a profile bar, and wherein the headbox is provided with a cross direction measuring assembly selected from the group consisting of a plurality of cross direction sensors and at least one traversing sensor, the method comprising the steps of:

determining a flow rate profile in the slice channel of the headbox by means of the cross machine direction measuring assembly;

adjusting the profile bar of the slice opening in the cross direction on basis of the flow rate profile; and wherein a trailing element is located in the slice channel of the headbox and is provided with a set of cross direction measuring sensor rows.

5. The method of claim 4 wherein the cross direction sensors are selected from the group consisting of ultrasonic sensors, surface friction detectors, acceleration transducers, microwave sensors, sensors based on optical measurement, and sensors based on the use of radioactive radiation.

6. The method of claim 4 wherein the shape of the slice opening is adjusted so as to be in the shape of the determined flow rate profile.

7. A measurement and control system for controlling a headbox in a paper/board machine, comprising:

a headbox having a slice channel with a slice opening and a profile bar which is adjustable to adjust the slice opening;

a measuring assembly selected from the group consisting of a plurality of sensors spaced from one another in the cross machine direction and at least one traversing sensor, the measuring assembly for determining a cross direction flow rate profile in the slice channel;

means for adjusting the profile bar on the basis of the determined flow rate profile; and a trailing element in the headbox, wherein the measuring assembly comprises measuring sensors placed in the trailing element.

8. The measurement and control system of claim 7 wherein the measuring assembly comprises a plurality of sensors placed in the cross direction before a turbulence generator and/or after it.

9. A headbox apparatus in a paper/board machine, comprising:

a stock inlet header;

a tube bank receiving a flow of stock from the stock inlet header, a turbulence generator receiving a flow of stock from the tube bank;

a slice channel which receives a flow from the turbulence generator, said flow passing out through a slice opening, the slice opening having a profile bar;

a measuring assembly selected from the group consisting of a plurality of sensors spaced from one another in the cross machine direction and at last one traversing sensor, the measuring assembly being positioned to determine a flow rate profile in the cross machine direction of the slice channel of the headbox; and a profile calculating unit which receives the measurements from the measuring assembly, and which sends control signal to a profile bar adjustment unit which adjusts the profile bar of the slice opening in the cross direction on the basis of the flow rate profile, wherein the measuring sensors are placed in a trailing element of the headbox.

10. The headbox apparatus of claim 9 wherein the measuring assembly comprises a plurality of sensors placed in the cross direction before the turbulence generator and/or after it.

* * * * *